US008844852B2

(12) United States Patent
Winsor

(10) Patent No.: US 8,844,852 B2
(45) Date of Patent: Sep. 30, 2014

(54) SYSTEM FOR BREAKING CAKED MATERIALS IN A RAILROAD HOPPER CAR

(75) Inventor: Robert B. Winsor, Montreal (CA)

(73) Assignee: Holden International, Inc. (BB)

( * ) Notice: Subject to any disclaimer, the term of this patent is extended or adjusted under 35 U.S.C. 154(b) by 333 days.

(21) Appl. No.: 13/309,253

(22) Filed: Dec. 1, 2011

(65) Prior Publication Data

US 2012/0138719 A1 Jun. 7, 2012

Related U.S. Application Data

(60) Provisional application No. 61/418,696, filed on Dec. 1, 2010.

(51) Int. Cl.
*B02C 19/00* (2006.01)
*B02C 23/02* (2006.01)

(52) U.S. Cl.
CPC ..... *B02C 23/02* (2013.01)
USPC ..... 241/283; 241/101.71; 241/152.2

(58) Field of Classification Search
USPC ..... 241/152.2, 101.71, 283
See application file for complete search history.

(56) References Cited

U.S. PATENT DOCUMENTS 3,213,911 A * 10/1965 Seydelmann ..... 241/82.4
4,655,401 A * 4/1987 Binzen et al. ..... 241/69

* cited by examiner

*Primary Examiner* — Mark Rosenbaum
(74) *Attorney, Agent, or Firm* — Ice Miller LLP

(57) ABSTRACT

A system for breaking up caked materials in a hopper car having a gravity discharge outlet is shown. The system includes an agitator that is a compressible strut linked through a rod to an externally driven crank shaft and a crank arm disposed above the discharge outlet. The system further includes at least one energizing coil coupled with the strut that provides irresistible force to caked material in the vicinity of the strut to initiate crumbling when the crank shaft is rotated, and to progressively crumble caked material along the length of the coil. The system further may have scrubbing panels along slope sheets of the hopper coupled with the coil, and may have arch members coupled with the energizing coils to provide further progressive agitation of caked material in the hopper car.

13 Claims, 11 Drawing Sheets

SYSTEM FOR BREAKING CAKED MATERIALS IN A RAILROAD HOPPER CAR

This application claims the benefit of U.S. provisional Patent Application Ser. No. 61/418,696, filed on Dec. 1, 2010, which is incorporated herein by reference.

BACKGROUND

Many free-flowing granular commodities are commonly transported in railcars called "bottom discharge covered hopper cars". These cars have a tank-like upper body on a lower body consisting of several tapered hopper sections, commonly three or four in number, terminating in rectangular discharge openings closed and sealed by horizontally sliding gate plates housed in frames. These assemblies are called gravity discharge gates. The cars are loaded though either circular or more commonly trough-like longitudinal hatch openings in the roof, such trough hatch openings being covered and sealed by hinged hatch covers.

A number of the normally free-flowing granular commodities transported in hopper cars have a tendency under certain conditions to bond, or "cake", during transit into a more viscous mass that retards their normal free-flowing characteristics. In some cases, this caked mass can have a very significant degree of structural integrity such that it will not flow at all under gravity alone but must first be broken up, or "crumbled" through applied mechanical means.

One commodity that has this tendency to cake is distiller's dried grain, known as "DDG" in the industry. The most voluminous example of DDG in North America is the residue from the process of making ethanol from corn. This residue product is excellent feed for livestock and is transported in bulk from the ethanol plants, located principally in central North America, to all regions in North America, employing approximately 11,000 very large bottom discharge covered hopper cars assigned specifically to this service. Thus, the effectiveness of this transport means is commercially important and the tendency to cake is a serious impediment in this respect.

There are a variety of means employed to crumble caked material such as DDG to permit it to flow out through the discharge gates. The most common method is to vibrate the hopper car slope sheets in order to loosen the bulk material and keep it somewhat fluidized as it flows. This is accomplished through the application of special vibrators into mounting brackets welded to the slope sheets of the tapered hopper sections of the hopper cars. All unloading facilities that handle DDG and like commodities are equipped with such vibrators, most driven by compressed air.

Very difficult DDG loads with exceedingly tenacious caking are fairly common, particularly in the summer months. In such cases, the side-mounted vibrators are not sufficient to disturb and break up the caked DDG inside, and additional means must be employed. One such means is through manual "picking" with a crow-bar applied up into the caked load through the bottom discharge gate opening in an attempt to cause the caked load to flow. The reach up from the bottom is limited and in many cases insufficient to cause free flow in the caked load.

The caked DDG can be sufficiently sticky that it will adhere to the sides of the hopper car and actually support overhanging structures in the load where the adjacent DDG has broken up and flowed away through the open discharge gates below. In these more difficult situations additional mechanical means are employed beyond the normal external vibration and picking through the outlet gate described above. Such means include more violent vibration waves caused by physical hammering of the sides of the hopper car with sledges as well as the use of large, pointed, poker-like prodding tools mounted on special hydraulic/mechanical machinery located on platforms above the hopper cars. These large prods are inserted through the loading hatches and manipulated to pick at the caked DDG from above. These large devices are effective at causing the caked loads to flow, but they are very expensive to buy and operate and only the larger unloading facilities can afford them.

It will be readily appreciated that this physical hammering with sledges and blind prodding from above with large, clumsy hydraulic equipment is inevitably extremely damaging, leaving large dents at each contact with the rail car hopper sheets. It will be further appreciated that an alternate, non-damaging and cost effective means of crumbling caked material would be of significant benefit to the industry. The purpose of the present invention is to provide such a cost effective mechanical cake-crumbling means, installed within the rail-car hoppers themselves.

There are other means that have been tried, including chemical additives to the DDG itself and other internally mounted load disturbing means but all have proven to be either too expensive or ineffective for breaking DDG when under the most severe caking conditions.

SUMMARY

The solution described herein provides that the caked material in a hopper car will be attacked in small but progressive bites initially crumbling only the small portion of the caked load that is immediately above the open outlet gate so it will fall through the opening, thus creating a void into which additional adjacent caked material can crumble thereafter if properly disturbed.

This can be accomplished through the excitation of a flexible system mounted inside the hopper car, supported from the car structure and interconnected elastically one element of the system to the next. Thus, an initial portion of the system can be excited to vibrate and attack the immediately surrounding caked material while the adjacent elements in the system are still restrained from motion by the caked material enveloping those elements. This elastic interconnection provides that the system, once excited, will progressively attack the caked material moving in bites from an already crumbled zone into an adjacent zone still caked, and progress in this manner eventually throughout the entire interconnected system.

In a preferred embodiment described herein there are several specific elements that are interconnected to make up the flexible system, each with a design purpose specific to the task of successive transmission of vibrations from one to the next element of the elastically interconnected elements of the system, while being able to vibrate themselves even when the adjacent interconnected element is restrained from vibrating by the surrounding cake of material.

This embodiment also provides that all elements are limited in size so that they can be inserted into the hopper car through the roof hatches, permitting economical retrofitting to the existing fleet.

BRIEF DESCRIPTION OF THE DRAWINGS

The invention can be better understood with reference to the following drawings and description. The components in the figures are not necessarily to scale, emphasis instead being placed upon illustrating the principles of the invention. In the drawings.

DETAILED DESCRIPTION

Figure 1:
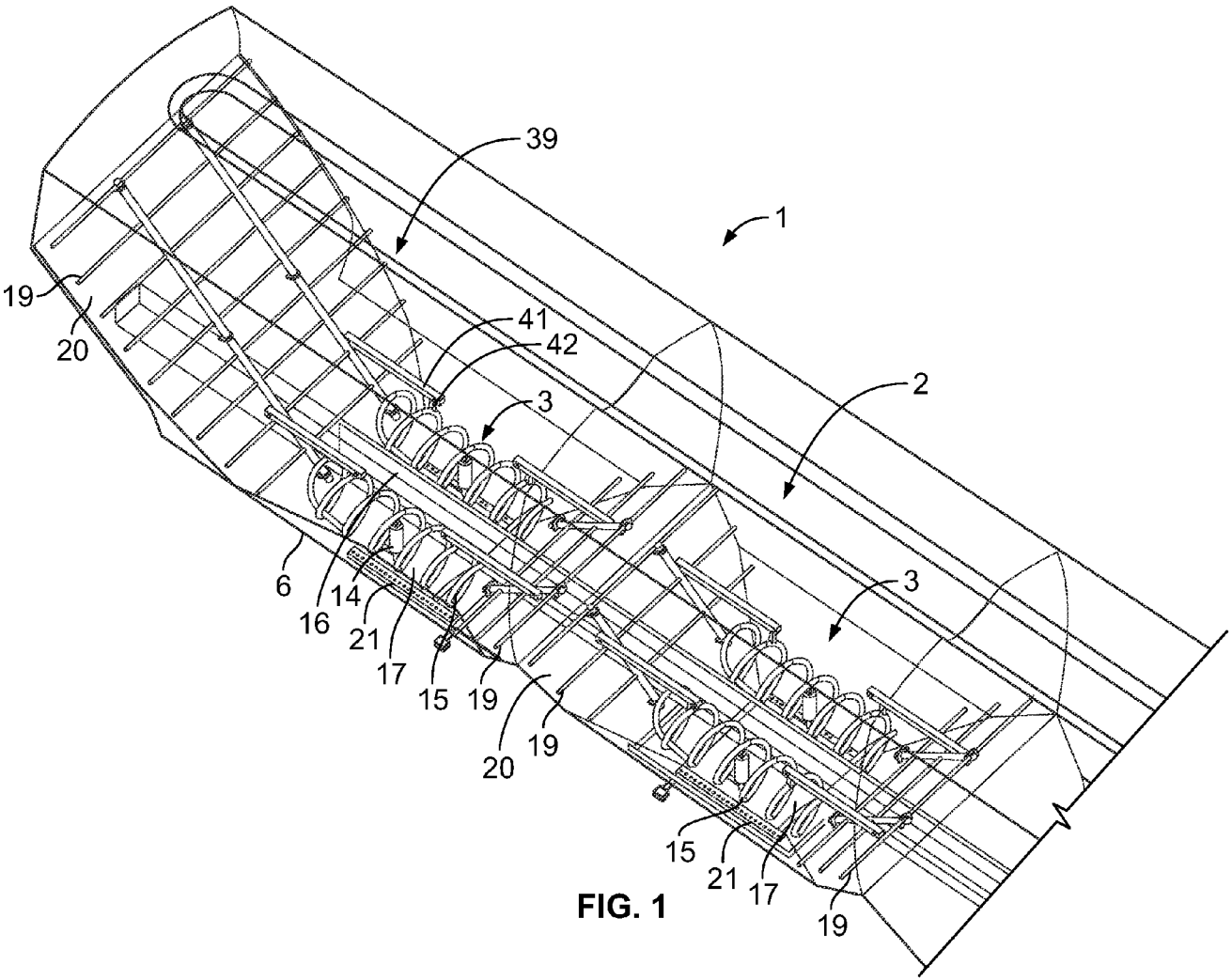
FIG. 1 is a transparent perspective view of a hopper car with some of the elements of an embodiment of the present invention.
Figure 2:
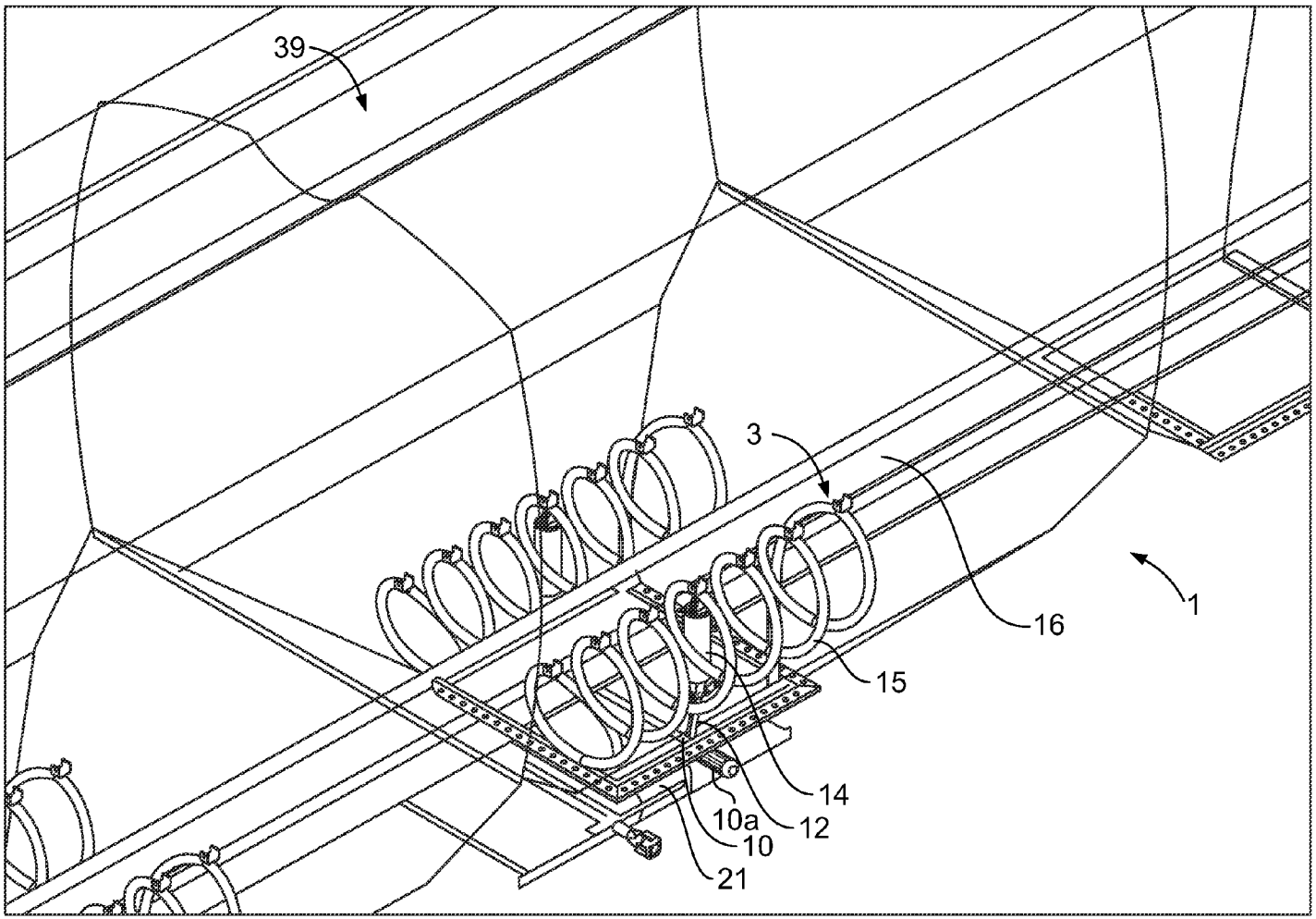
FIG. 2 is a transparent perspective view of a section of a hopper car with some of the elements of an embodiment of the present invention.

As shown in FIG. 1, the present invention is a system 3 which is installed in a hopper section 2 of a hopper railcar 1. The hopper car shown in the Figures has two hopper sections 2 with gravity discharge gates 21 covering discharge openings 17, and has a center sill 16 that runs longitudinally along the hopper car, although the invention can be modified to fit inside cars not having this center sill. The hopper car 1 of this design also has a longitudinal roof hatch 39 running the length of the car. All of the components of the system listed below are designed so as to fit through this hatch 39 to be assembled inside car 1. In this view, it can be seen that each system 3 includes an excitation strut 14, coupled with energizing coils 15, which in turn coupled with scrubber panels 19. The bite-by-bite action resulting in the escape of material from each hopper section 2 begins at the excitation strut 14, which is disposed above discharge outlet 17, which is agitated by the action of crank shaft 10 (not shown in FIG. 1). The area around excitation strut 14, once cleared of DDG, allows the coupled energizing coil to vibrate in the caked material, with successive windings of energizing coil 15 further and further away from excitation strut 14 vibrating as the material is progressively dislodged. Eventually, the energizing coils 15 will become sufficiently free to begin agitating scrubber panels 19, which move up and down slope sheets 20. FIG. 2 is a close-in view of the same device, this time showing crank shaft 10 that drives the agitation of excitation struts 14, but not showing scrubber panels 19. In this embodiment, crank shaft 10 extends through discharge gate 21 and its rotation drives the vibration of excitation strut 14 through articulating linkage 12.

Figure 3:
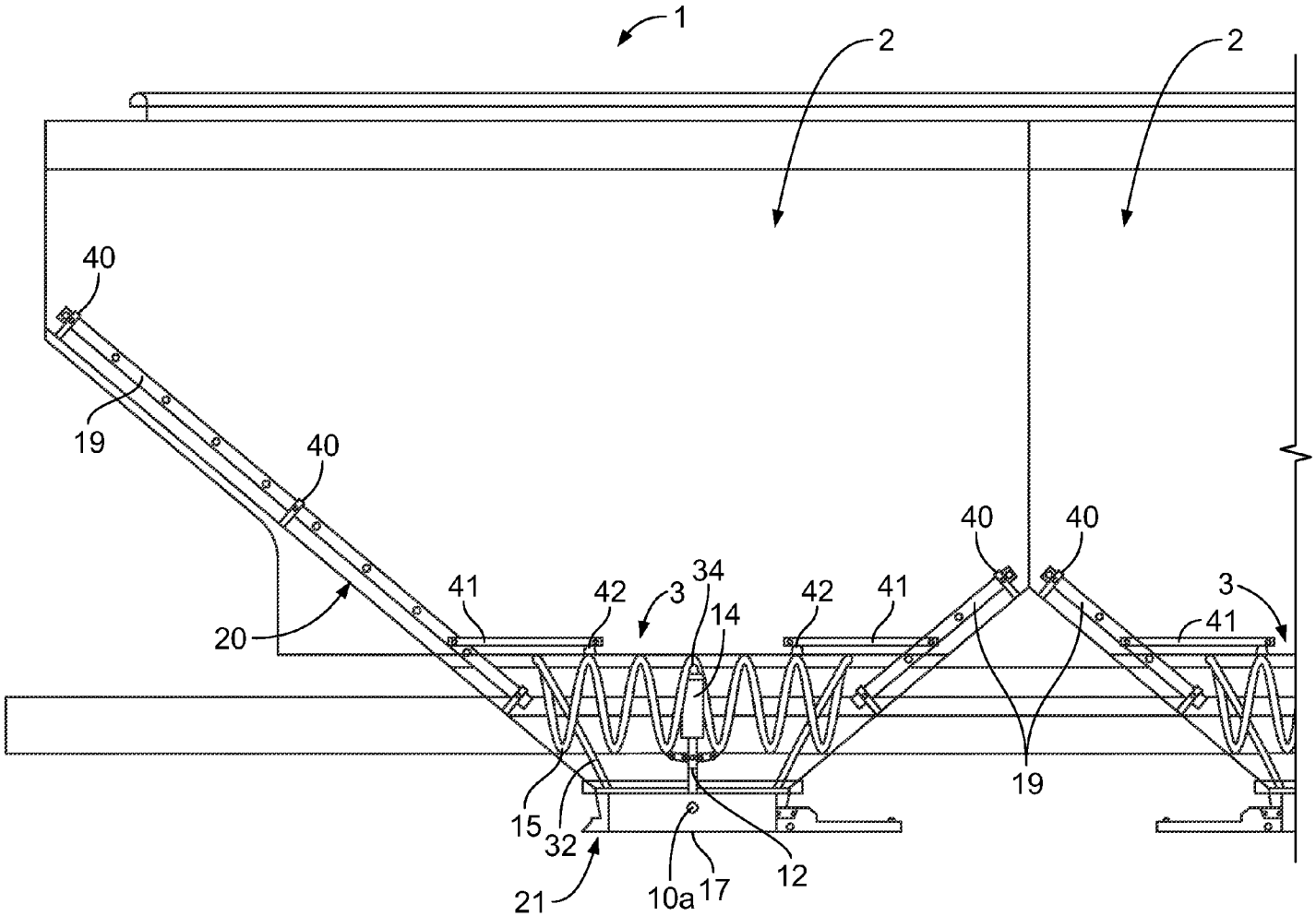
FIG. 3 is a side view of a section of a hopper car with some of the elements of an embodiment of the present invention.
Figure 9:
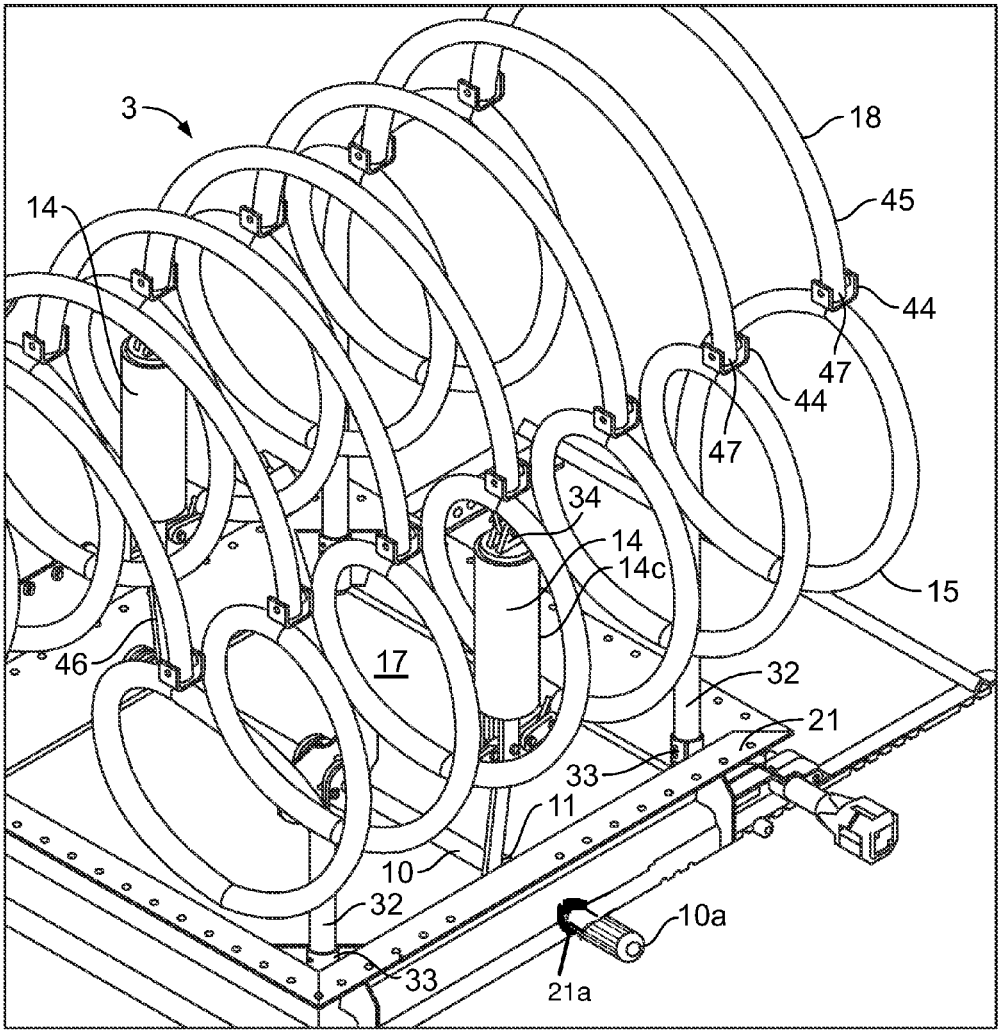
FIG. 9 is a perspective view of some elements of an embodiment of the present invention.
Figure 10:
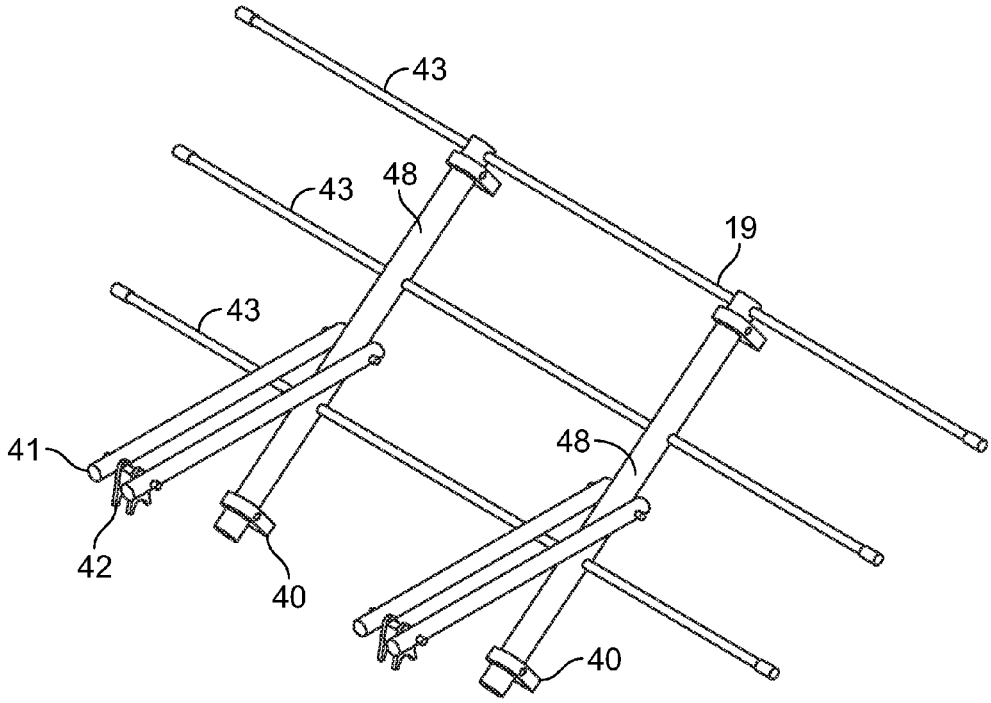
FIG. 10 is a perspective view of a scrubber panel according to an embodiment of the present invention.
Figure 11:
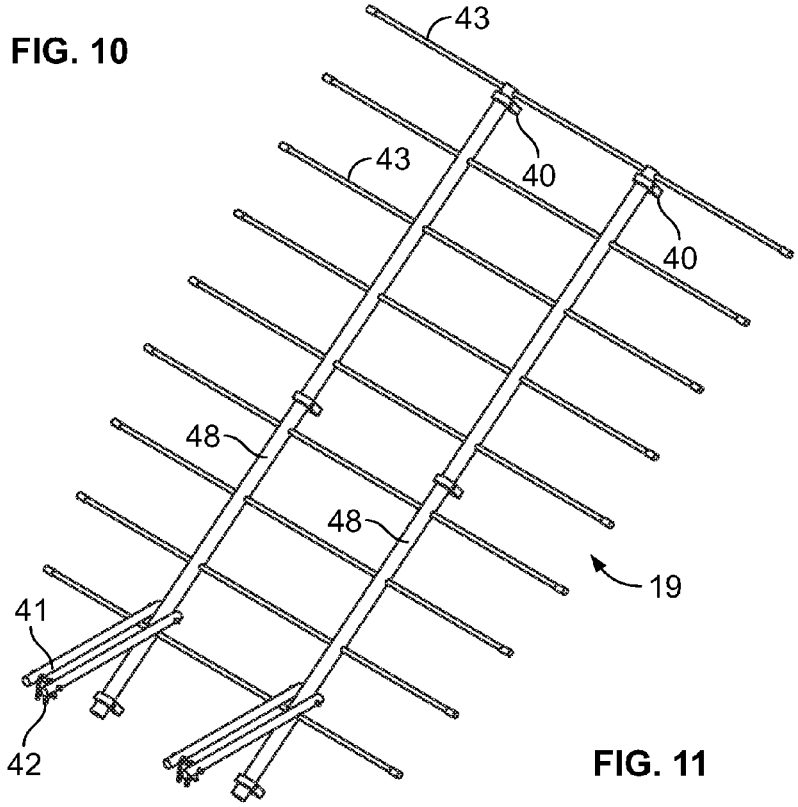
FIG. 11 is a perspective view of another scrubber panel according to the present invention.

As shown in further detail, FIGS. 3, 4, 7 and 9, each system 3 in the preferred embodiment contains a crank shaft 10 with at least one crank arm 11. In the embodiment shown in FIG. 4, the crank shaft 10 is attached to two crank arms 11 on either side of center sill 16. The crank shaft 10 is mounted so as to run through the hopper section 2 from side to side of the hopper car 1, arranged with ends 10*a* configured to be engaged and rotated by external equipment available at the unloading facilities. Each crank arm 11 is connected to an articulating linkage system 12 comprised of three separate inter-connected links: a push/pull rod 26 and toggle links 27 and 28, that connect the crank arm 11 of the crank shaft 10 to excitation strut 14 and energizing coils 15. A compressible-extendible excitation strut 14 initiates vibration in the system even though the system is embedded in caked material. The system 3 further comprises at least one large energizing coil 15 mounted to the toggle links 27 and 28, and the excitation strut 14. In the embodiment shown in FIGS. 1, 2, and 9, two energizing coils 15 are mounted on each side of the center sill 16, directly over and in close proximity to the discharge openings 17 in the discharge gates 21. As shown in FIG. 3, the system 3 further includes scrubber panel 19 connected to the energizing coil or coils 15 by connecting struts 41, moveably supported by and parallel to the underlying hopper lateral slope sheets 20; in the embodiment shown, two scrubber panels 19 are located fore and aft of each discharge opening 17. In a preferred embodiment shown in FIG. 9 there may be a series of arch members 18 extending from the tops of the two parallel energizing coils 15 thereby connecting them over the center sill 16, as shown in FIG. 9.

Figure 4:
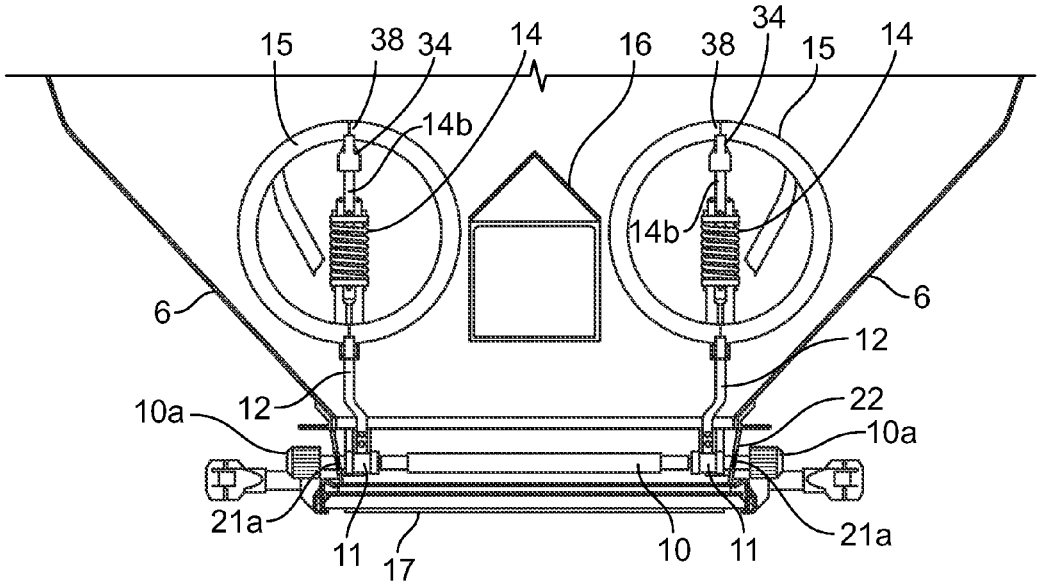
FIG. 4 is an end view of a section of a hopper car with some of the elements of an embodiment of the present invention.
Figure 7:
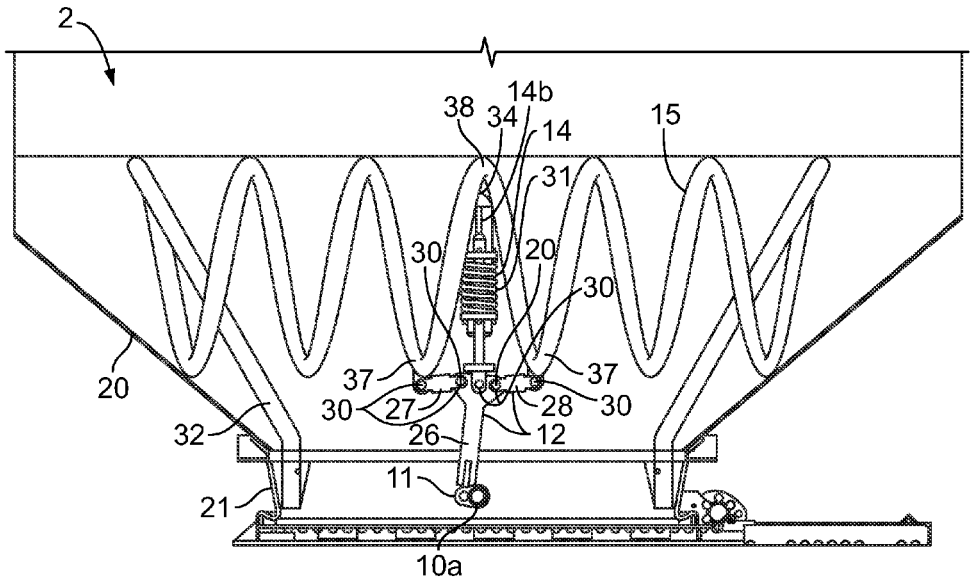
FIG. 7 is a side view of a section of a hopper car with some of the elements of an embodiment of the present invention.

FIGS. 4 and 7 show a crank shaft 10 according to the present invention. In the embodiment shown, the crank shaft 10 runs from side to side of the railcar 1 through bearing sleeves 21*a* in the gravity discharge gate 21 terminating at ends 10*a*, facilitating retrofit but also to be as close as possible to the opening 17 itself to insure the initially crumbled caked material falls immediately through the discharge opening 17 in the discharge gate 21. Alternatively, the crank shaft 10 may also be run through bearing sleeves 21*a* in the hopper structure side slope sheets 6.

Figure 5A:
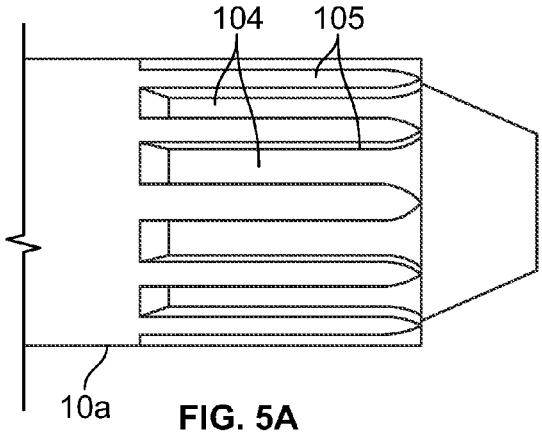
FIG. 5A is a side view of the spline end of a crank shaft according to an embodiment of the present invention.
Figure 5B:
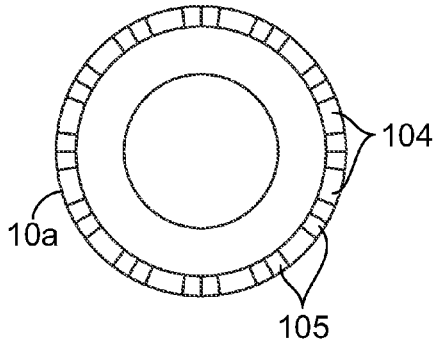
FIG. 5B is end view of the spline end of a crank shaft according to an embodiment of the present invention.
Figure 6A:
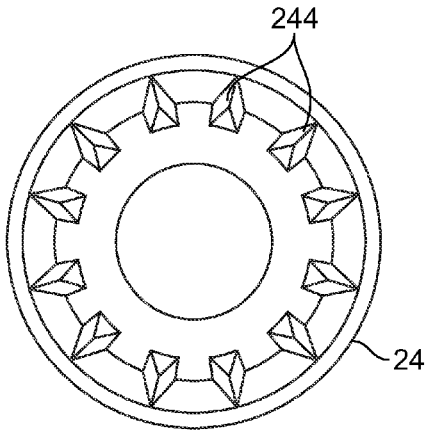
FIG. 6A is an end view of the spline end of a drive nut according to an embodiment of the present invention.
Figure 6B:
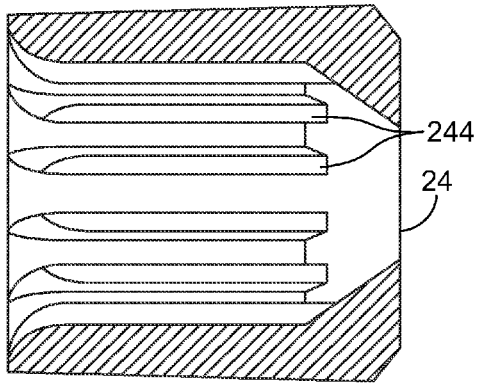
FIG. 6B is a side view of the spline end of a drive nut according to an embodiment of the present invention.

As shown in FIGS. 5A and 5B, the ends 10*a* of the crank shaft 10 may have grooves 104 and splines 105 so as to be readily engaged by a splined drive nut 24 with a mating shape, as shown in FIGS. 6A (end view) and 6B (side cutaway view). The splined drive nut 24 as shown in a FIG. 6A may be a cup having parallel splines 244 that mate with the grooves 104 of splined end 10*a*. The splined drive nut may be attached at the end of a separate power wrench located at the unloading facilities. The splined drive nut may also be driven by an internal combustion engine to be located at the unloading facilities. It should be noted that the above description is not limiting, and any system capable of transferring rotational power to the crank shaft 10 is within the scope of the invention.

FIGS. 7 and 12-17 show an articulating linkage system 12 driven by crank shaft 10 and crank arm 11 according to the present invention. Each articulating linkage system 12 includes three separate linking members: a vertically oriented "push/pull" rod 26 that connects the crank arm 11 of the crank shaft 10 to the lower end 14*a* of the excitation strut 14, which strut is disposed a short distance above the discharge gate 21; and two horizontally oriented "toggle" links 27 and 28 connecting the upper end of the push/pull rod 26 to the lower portions of adjacent loops 37 of the energizing coils 15. These toggle links 27 and 28 serve to keep the excitation struts 14 aligned generally in a near-vertical orientation between the two adjacent loops of the energizing coil 15, as well as to force the coil loops to move longitudinally in and out a small amount but with great force as the push/pull rod 26 oscillates with the rotating crank shaft 10. The toggle links 27 and 28 are linked to the energizing coil 15 through pivoting brackets 34. Toggle links 27 and 28 connect to push/pull rod through pivots 30, permitting free rotation. When agitated by the rapid rotation of crank arm 11, the articulated linkage system 12 combines with the excitation strut 14 to initiate movement and vibration in the energizing coils 15, as described below.

Figure 8B:
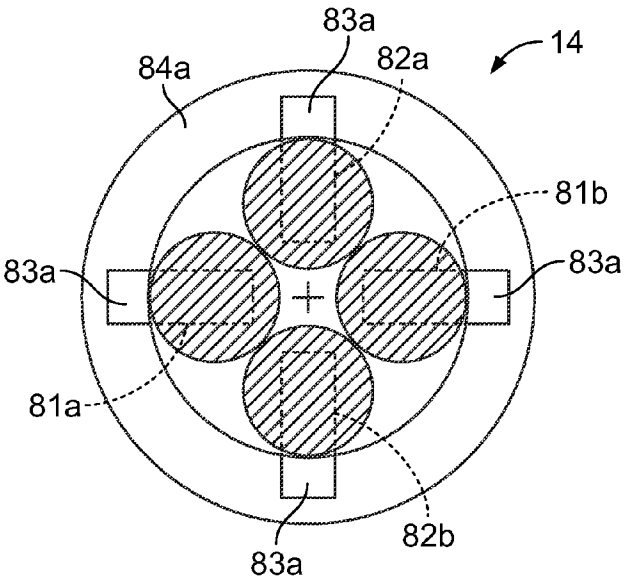
FIG. 8B is a partial sectional view of an excitation strut according to an embodiment of the present invention.

FIGS. 7-9 show an excitation strut 14 according to the present invention. The excitation strut 14 is spring-based, and is connected to the push/pull rod 26 through lower end 14*a*. The strut 14 has a lower arm 14*a* that is connected to push/pull rod 26 by a third pivot 30. The strut 14 has an upper arm 14*b* connected to an upper point 15*a*15*a* of the center loop 38 of energizing coil 15 by another pivoting bracket 34. The strut may also have a housing 14*c* surrounding the spring 31. The excitation struts 14 are constructed such that the distance between lower arm 14*a* and upper arm 14*b* be either extended or shortened in length by the action of spring 31 incorporated in the excitation struts 14. The spring 31 has sufficient stiffness to provide a powerful reversing load to to caked material when it is compressed by the throw of crank arm 11 through push/pull rod 26. The excitation strut 14 will then accommodate, if necessary, the full throw of the rotating crank arm 11 even if the energizing coils 15 are solidly encased in an unyielding caked material. Thus, even in a severely caked load, the crank arm 11 will rotate and the lower portion of the push/pull rod 26 and the lower arm 14*a* will oscillate with the crank arm 11, but the internal spring compression in the excitation strut 14 will permit the excitation strut 14 to simply change length such that the energizing coil 15 need not move vertically at all, albeit being urged to do so under considerable reversing loads caused by the compressing of the spring 31.

Figure 8A:
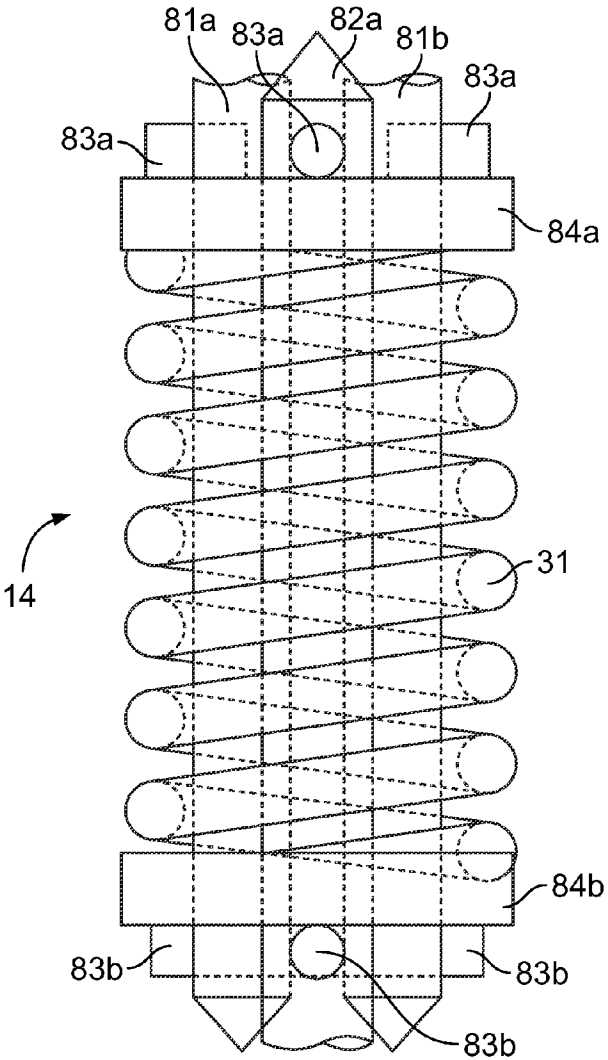
FIG. 8A is a cutaway side view of an excitation strut according to an embodiment of the present invention.

A close up view of one design for an embodiment of excitation strut 14 is shown in FIGS. 8A (side view) and 8B (top view). The excitation strut includes two posts 81*a* and 81*b* that attach to top arm 14*b*, and two posts 82*a* and 82*b* that attach to the lower arm 14*b*. The four posts are disposed inside a compression spring 31. Two circular floating spring seats 84*a* and 84*b*, are mounted to both ends of compression spring 31, each of the spring seats surrounding the four posts 81*a*, 81*b*, 82*a*, and 82*b*. Each of the four posts has an upper engagement pin 83*a* and lower engagement pin 83*b*, extending perpendicularly from both ends of each of the posts 81*a*, 81*b*, 82*a*, and 82*b*, so that the pins 83*a* abut the upper spring seat 84*a* just above the seat, and the lower engagement pins 83*b* engage the lower spring seat 84*b* just below the seat. The excitation strut 14 is assembled in this fashion with the spring in a "resting" state. When installed, if the lower push/pull rod 26 moves up or down while the upper linkage 38 is still frozen in caked material, the spring 31 will compress due to the pulling of the engagement pins 83 on the seats 84*a* or 84*b*.

FIGS. 1-3, 7 and 9 show energizing coils 15 according to the present invention. The energizing coils 15 are large, stiff metallic coils similar to very large helical springs, running fore and aft parallel to the center sill 16 of the railcar 1 and mounted and flexibly supported by end arms 32 extending down to mounting brackets 33 in the car structure. The loops of energizing coil 15 in this embodiment, are around 22 inches in diameter, with successive loops approximately 12 inches apart. In the preferred embodiment, the brackets 33 are formed as part of the discharge gate 21 to facilitate retrofitting; however, the brackets may also be formed on the slope sheets of the hopper car. The stiffness of the energizing coils 15 is sufficient as to create very powerful vibrations in the energizing coils 15 when excited by the excitation struts 14 after the central loop 38 has broken free of the initial caked material that immobilized it at the outset of the excitation process. These powerful vibrations serve to carry the cake-crumbling capability from loop to loop outwards along the energizing coils 15 with great strength, enabling each successive loop of energizing coil 15 to gradually break free of the encapsulating caked material and cause the cake to crumble into the increasingly voluminous cavity forming over the discharge opening 17 in the discharge gate 21. The energizing coils 15 also serve to break up lumps of caked material that are subsequently released from above and fall into the area over the discharge opening 17, thus assuring that the passageway through the hopper opening remains free-flowing.

This combined action of excitation strut 14 and linkage system 12 serves to apply a powerful, reversing, repetitious loading of the center loops of the energizing coils 15, urging these loops to break free of and crumble the surrounding caked material in the central region right over the discharge opening 17 and initiating the progressive crumbling action of the entire system as it continues to be energized. The horizontally orientated toggle links 27 and 28 apply a reversing loading that is irresistible (in the context of the strength of the caked material), and this forces the bottom portions of the adjacent loops 37 of the center loop 38 of the energizing coil 15 to move a short distance in and out as the toggle links 27 and 28 articulate with the oscillating push/pull rod 26 due to the rotating crank arms 11. The rotating crank arms 11 in themselves provide a crumbling force that is also irresistible in this context of the strength of the caked material. The force provided by the crank arms 11 together with the action of the toggle links 27 and 28 described above causes the caked material in the area to crumble and fall away. Once this initial crumbling has occurred, the center loops 38 of the energizing coils 15 become free to move somewhat, at least in the downwards direction, under the continued urging of the repetitively compressing spring 31 in the excitation struts 14. Thus, the center loops 38 will become wholly free to move the distance dictated by the rotating crank arms 11, and the loops will transfer loading laterally into the adjacent loops 37 of the energizing coils 15, propagating the crumbling process further outwards from the center in the same fashion as did the center loops 38.

Figure 12:
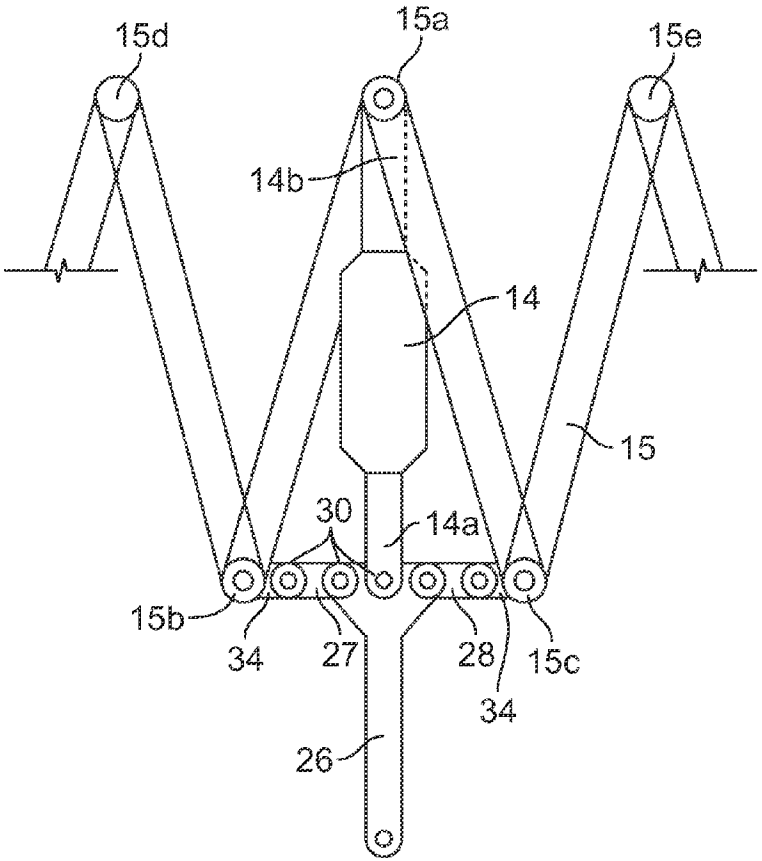
FIG. 12 is a side view of an articulating linkage system according to an embodiment of the present invention.

The combined action of the excitation strut 14 and the articulating linkage system 12 with energizing coil 15 to initiate crumbling in a caked hopper car load is shown in FIGS. 12-17. FIG. 12 is a reference position that shows the linkage 12 and excitation strut 14 and energizing coil 15, shown hanging free and not connected to the crank shaft 10. The linkage 12 and excitation strut 14 is joined to energizing coil 15 at points 15*a* (with the upper arm 14*b*), 15*b* (with toggle link 27) and point 15*b* (toggle link 28). Note that the linkages are never exactly in the position shown in FIG. 12 when installed, because the push/pull rod 26 is connected to the crank arm 11, which is offset from the crank shaft 10.

Figure 13:
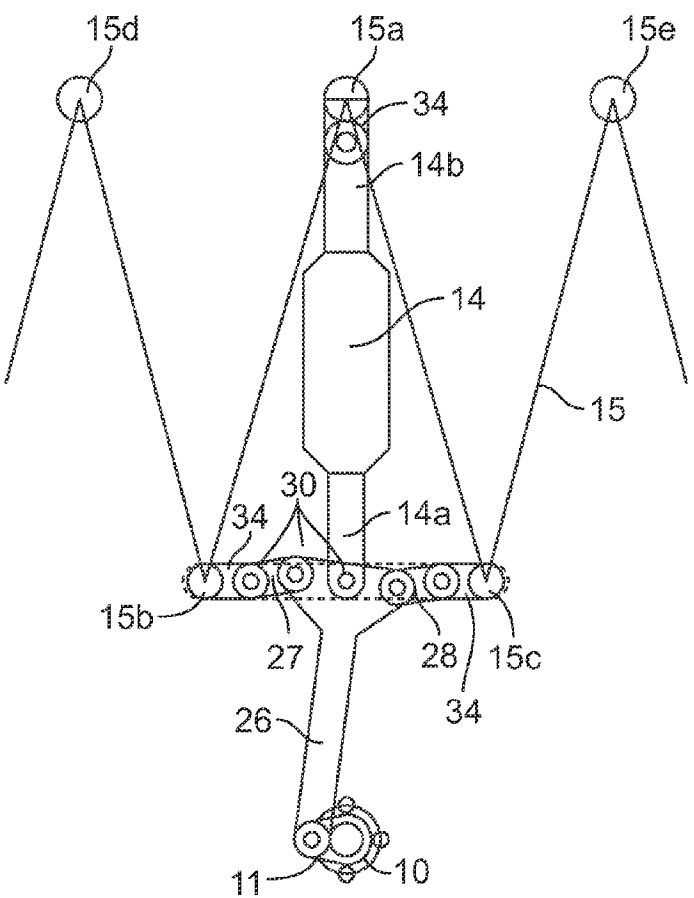
FIG. 13 is a side view of an articulating linkage system according to an embodiment of the present invention as the crank shaft is rotated.

FIG. 13 shows the linkage system 12 with the crank arm 11 at 9 o'clock with respect to crank shaft 10, with reference to position shown in FIG. 12 (illustrated here as dotted lines). In FIG. 13, all points 15*a*-15*e* are frozen in caked material. Note that in FIGS. 13-17, the energizing coil 15 is shown schematically. The push/pull rod 26 in this position causes toggle links 27 and 28 to be slightly angled with respect to push/pull rod 26, with the sections 15*b* and 15*c* of energizing coil 15 pulled slightly towards one another. The rotation of the crank shaft 10 and swing of the push/pull rod 26 initiate the crumbling of caked material in this area. The slight movement of the toggle links 27 and 28 and sections 15*b* and 15*c* causes caked material to crumble further up the caked mass.

Figure 14:
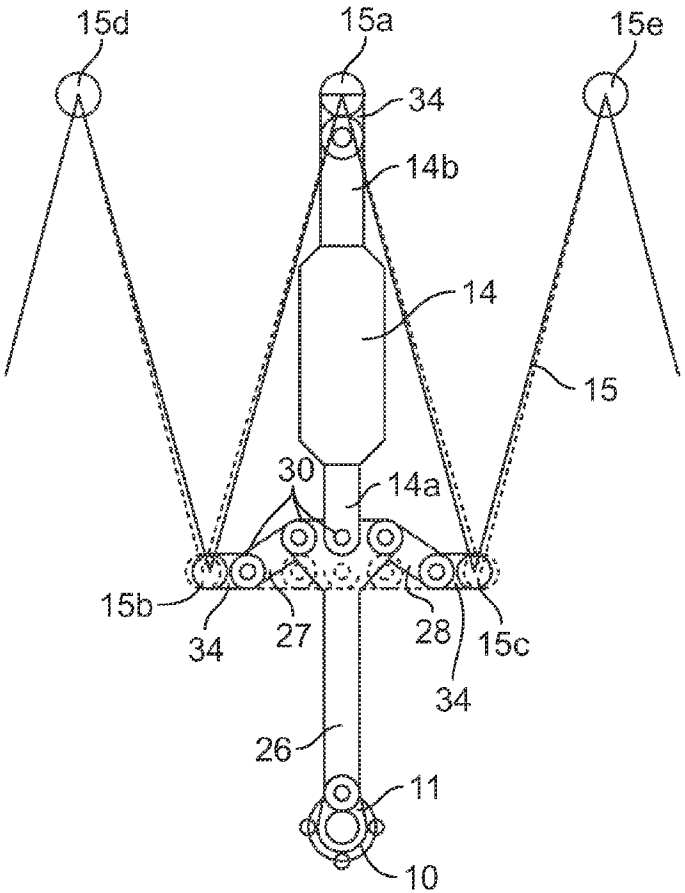
FIG. 14 is a side view of an articulating linkage system according to an embodiment of the present invention as the crank shaft is rotated.

FIG. 14 shows the linkage system 12 as installed with the crank arm 11 at 12 o'clock, with reference to position shown in FIG. 12 (illustrated here as dotted lines). Points 15*a*, 15*d*, and 15*e* are frozen in caked material in this figure. Because points 15*a*, 15*d*, and 15*e* are immobile because of caked material, the push/pull rod 26 drives lower arm 14*a* upward to compress spring 31 of excitation strut 14, and points 15*b* and 15*c* are pulled towards one another with an essentially irresistible force, because links 27 and 28 are angled downward with respect to push/pull rod 26. As the crank arm 11 repeatedly moves between 9 o'clock (as shown in FIG. 13) and 3 o'clock (the mirror-image position), the toggle links repeatedly push and pull points 15*b* and 15*c* toward and away from each other with essentially irresistible force. The compressed spring 31 is compressed, and the load of the compressed spring serves to urge upper arm 14*b* and coil point 15*a* upward. At the same time, the toggle links 27 and 28 urge the energizing coil sections around points 15*b* and 15*c* upward, which in turn urge upward points 15*a*, 15*d*, and 15*e* through the energizing coil 15.

Figure 15:
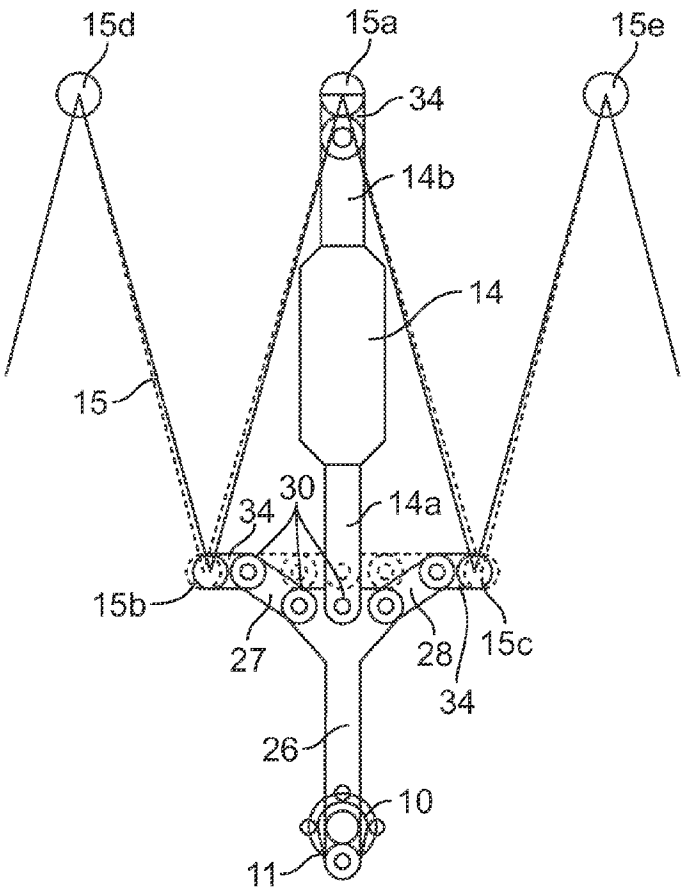
FIG. 15 is a side view of an articulating linkage system according to an embodiment of the present invention as the crank shaft is rotated.

FIG. 15 shows the linkage system 12 as installed with the crank arm 11 at 6 o'clock, with reference to position shown in FIG. 12 (illustrated here as dotted lines), and with point 15*a* remaining frozen in caked material. As in FIG. 15, because points 15*a*, 15*d*, and 15*e* remain frozen, the links 27 and 28 are angled upward from push/pull rod 26, pulling points 15*b* and 15*c* towards one another with essentially irresistible force. The lower arm 14*b* of excitation strut 14 is pulled downward, causing the excitation strut 14 to compress, fully loading the internal spring 31 of excitation strut 14. At the same time, toggle links 27 and 28 urge points 15*b* and 15*c* downward, to urge movement in the coil sections linked to points 15*a*, 15*d*, and 15*e*. The repeated cycling of the crank arm between the positions shown in FIGS. 13-15 will eventually cause the caked material to crumble in the area around points 15*a*-15*e*.

Figure 16:
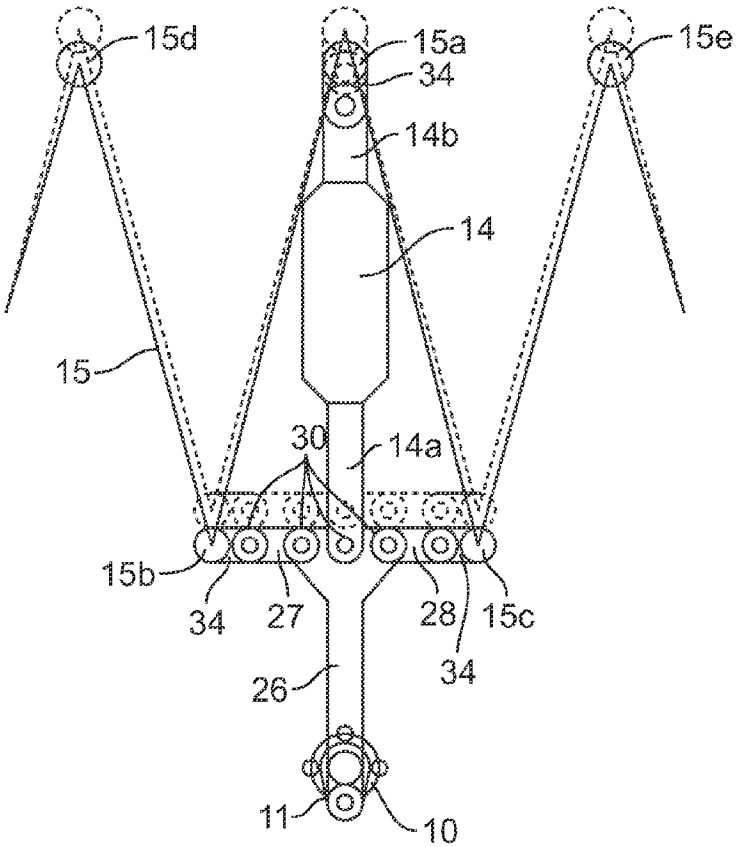
FIG. 16 is a side view of an articulating linkage system according to an embodiment of the present invention as the crank shaft is rotated.

FIG. 16 shows the linkage system 12 with the crank arm 1 at 6 o'clock, with reference to position shown in FIG. 12 (illustrated here as dotted lines), this time after the caked material has finally crumbled around Sections 15*a*-15*e* after successive cycling. The excitation strut 14 is no longer compressed, and toggle links 27 and 28 now move downward in the crumbled material, roughly perpendicular with push/pull rod 26. Points 15*a*-15*e* of energizing coil 15 also move downward together by the length of the throw of crank arm 11, and this action urges the same movement in energizing coil sections further away from excitation strut 14.

Figure 17:
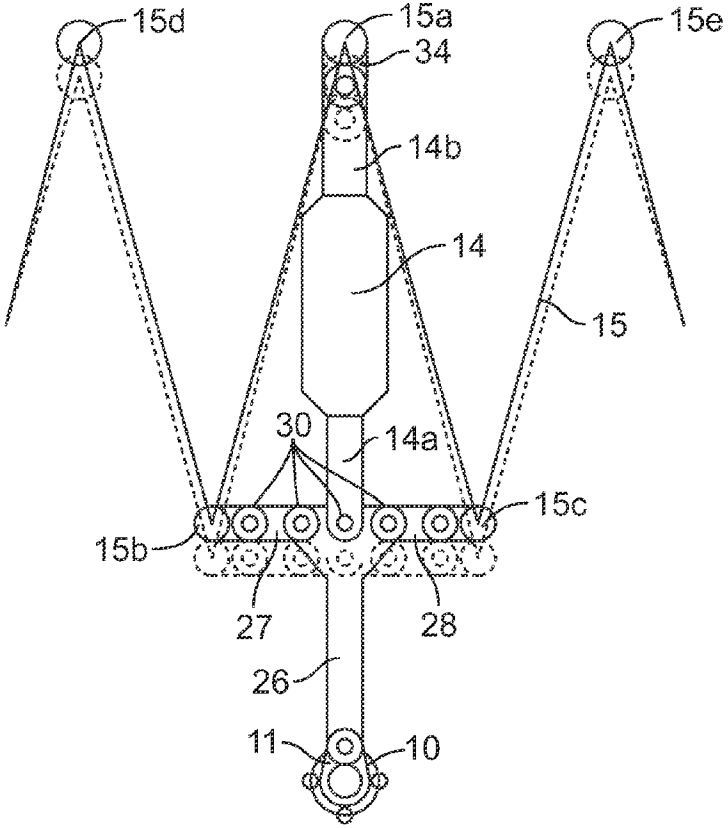
FIG. 17 is a side view of an articulating linkage system according to an embodiment of the present invention as the crank shaft is rotated.

FIG. 17 shows the linkage system 13 with crank arm 11 at 12 o'clock, with reference to position shown in FIG. 12 (illustrated here as dotted lines), again now viewed after the caked material has crumbled around sections 15*a*-15*e*. As in FIG. 16, because 15*a*-15*e* are relatively free to move, there is no longer a large load on excitation strut 14, and it returns to its free length, and toggle links 27 and 28 now move upward roughly perpendicular with push/pull rod 26. Points 15*a*-15*e*, having moved upwards approximately 1.5 inches, now pull adjacent loops on energizing coil 15 so as to urge those loops upward. Therefore, in FIGS. 16 and 17, as the crank arm moves from 12 o'clock and 6 o'clock, the loops of energizing coil 15 closest to excitation strut 14 move up and down rapidly, urging neighboring coil loops to also move upward and downward with great force. This causes the caked material around neighboring energizing coil loops to eventually crumble away.

FIG. 9 shows arch members 18 according to the present invention. The arch members 18 extend the reach of the system 3 vertically into the caked material so that the effect of the system 3 will be extended higher into the cake than the top of the energizing coils 15. This additional reach provided by the arch members 18 will assist in crumbling the caked material located above the center sills 16 and supported by those sills. In the preferred embodiment, these arch members 18 are approximately semicircular bent metallic bars with ends 45 and 46 mounted on the connection points 47 on the tops of loops of the energizing coils 15. In the preferred arrangement, each end 18*a* is mounted to a different energizing coil 15. This arrangement provides that, with the crank arms 11 of the crank shaft 10 set at 180° to each other, one end 45 of the arch member 18 will be moving down while the other end 46 is moving up, and the arch member 18 itself will slide within a semicircular cavity that the cake formed around it when being loaded. There is little resistance to the arch members 18 moving as described, even when the arch members are set in a caked load, and thus the arch members 18 will not significantly retard the vibration of energizing coils 15. it is not until the loops within the energizing coils 15 start trying to vibrate back and forth parallel to the energizing coil centerline that this back and forth motion will cause the ends 45 and 46 of the arch members 18 to also begin to move back and forth laterally as the caked material begins to crumble adjacent the joint of the arch members 18 and the loop top brackets 44. This carries the crumbling motion of the energizing coils 15 further and further into the caked material above the energizing coils 15 through the upward extending arch members 18.

In the preferred embodiment, the energizing coils 15 are connected to scrubber panels 19. FIGS. 1, 3, 10 and 11 show scrubber panels 19 according to the present invention. The scrubber panels 19 are separate, flat, open-construction lattice panels moveably supported on downwardly projecting sliding feet 40 on and just above the lateral slope sheets 20 fore and aft of each outlet opening, straddling the center sills 16 and covering the general area of the lateral slope sheets 20. As shown in FIGS. 1 and 3, the scrubber panels 19 over the lateral slope sheets 20 at the ends of the railcar 1 are much larger than those on the lateral slope sheets 20 between the hopper openings due to the railcar construction, but are otherwise the same and are connected to the energizing coils 15 in the same way. The scrubber panels 19 are connected to the energizing coils 15 through stiff connecting struts 41, which are pinned to at least one of the stiff longitudinal members 48 running parallel to the car center line in each scrubber panel 19. The connecting struts 41 are connected to the energizing coils 15 through brackets 42 located at the top of the loops at the ends of each of the energizing coils 15 furthest from excitation strut 14. The scrubber panels 19 have laterally oriented, thin, flexible arms 43 extending across and joined to the stiff longitudinal members 48. The flexible arms 43 extend generally side to side across the entire area of the lateral slope sheets 20. Thus, the vibrations in the energizing coils 15 will transfer through the stiff connecting struts 41 to urge the longitudinal members 48 to move parallel to the underlying lateral slope sheets 20 fore and aft relative to the hopper opening and generally parallel to the centerline of the car 1. Because the scrubbing panels 19 are coupled to the energizing coil 15, the scrubbing panels will not significantly retard the vibration of energizing coil 15, even if the scrubbing panels 19 are immobilized. The motion of scrubbing panels 19 will be initially restricted by the caked material surrounding the thin flexible arms 43 which are oriented across the direction of the urged motion and hence will initially act to prevent such motion. Gradually, the scrubber panels 19 will work free of the caked material, beginning near the stiff connecting struts 41 as the thin flexible arms 43 will flex to permit the initiation of motion. The resultant crumbling that follows allows further motion by the scrubber panel 19 as a whole, which is an extension of the bite-by-bite process that is facilitated by and throughout the entire interconnected system 3.

While various embodiments have been described, it will be apparent to those of ordinary skill in the art that many more embodiments and implementations are possible within the scope of the invention. For example, in hopper cars not having a center sill, the system may be implemented with only one crank arm and associated linkage structure in each hopper section. Accordingly, the invention is not to be restricted except in light of the attached claims and their equivalents.

I claim:

1. A device for breaking up caked material in a hopper having a gravity discharge outlet, comprising:

a first vibration agitator configured to be attached to and driven by an external driving motor, said first vibration agitator being disposed inside the hopper near the discharge outlet, the first vibration agitator being capable of agitating caked material when the hopper is loaded with caked material; and one or more secondary vibration agitators in the hopper coupled with the first vibration agitator, such that the first vibration agitator can agitate caked material near the outlet of the hopper when the secondary vibration agitators are immobilized by caked material, and wherein the first vibration agitator breaks up sufficient caked material so as to progressively allow the secondary vibration agitators to agitate and break up caked material in the vicinity of the secondary vibration agitators.

2. The device according to claim 1, wherein the first vibration agitator is a compressible excitation strut capable of being agitated by rotating an externally driven crank shaft.

3. The device according to claim 2, wherein the secondary vibration agitator is an energizing coil mounted inside the hopper above the discharge outlet, wherein the energizing coil is pivotably coupled with the strut.

4. The device according to claim 3, wherein the energizing coil has successive loops, and wherein the coil loops closest to the strut can vibrate, even when loops further from the strut are immobilized by caked material, and wherein the vibration of the loops closest to the excitation strut urge the loops further from the excitation strut to successively vibrate and break up caked material.

5. The device according to claim 4, wherein the excitation strut is linked to the crank shaft by a crank arm and push/pull rod, the push/pull rod is coupled with two lower portions of the loops of the energizing coil through pivoting toggle links, and an upper arm of the excitation strut is pivotably coupled with the energizing coil at an upper portion of a loop of the energizing coil.

6. The device according to claim 5, wherein the excitation strut, push/pull rod, and toggle links are capable of being rotated with sufficient force to break up caked material in the vicinity of the excitation strut.

7. The device according to claim 4, further comprising at least one scrubber panel disposed along a slope sheet of the hopper, the scrubber panel connected to an energizing coil by one or more linking struts, the scrubber panel comprising a lattice of stiff longitudinal members and flexible horizontal arms.

8. The device according to claim 7, wherein the scrubber panel is pivotably connected to the energizing coil through at least one connecting strut attached to a loop of the energizing coil distant from the excitation strut.

9. The device according to claim 3, wherein the device comprises two excitation struts and two energizing coils.

10. The device according to claim 9, wherein the two energizing coils are connected by one or more arched members that extend upward into the hopper.

11. The device according to claim 9, wherein the two energizing coils are horizontally disposed on either side of a center sill of the hopper.

12. The device according to claim 2, wherein the crank shaft is mounted across the discharge outlet, and mounted either to sloping walls of the hopper, or to a discharge gate of the hopper, and wherein at least one end of the crank shaft is configured to mate with an external driving motor.

13. The device according to claim 1, wherein the first vibration agitator and secondary vibration agitators are sized so as to fit through a roof hatch of a hopper car.

* * * * *